US006964503B2

(12) United States Patent
Smith et al.

(10) Patent No.: US 6,964,503 B2
(45) Date of Patent: Nov. 15, 2005

(54) AUTOMATED LUMINAIRE WITH LIGHT BEAM POSITION ADJUSTMENT

(76) Inventors: Carroll W. Smith, 16709 Amber Lake, Weston, FL (US) 33331; Derek J. Nash, 585 Dee Dee Dr., Christiansburg, VA (US) 24073; Ruben Villarreal, 12658 NW. 14th Pl., Plantation, FL (US) 33323

( * ) Notice: Subject to any disclaimer, the term of this patent is extended or adjusted under 35 U.S.C. 154(b) by 41 days.

(21) Appl. No.: 10/434,477

(22) Filed: May 9, 2003

(65) Prior Publication Data

US 2004/0070984 A1 Apr. 15, 2004

(Under 37 CFR 1.47)

Related U.S. Application Data

(60) Provisional application No. 60/393,119, filed on Jul. 3, 2002.

(51) Int. Cl.[7] ..... F21V 15/00

(52) U.S. Cl. ..... 362/371; 362/271; 362/285; 362/427

(58) Field of Search ..... 362/285, 287, 362/269, 270, 271, 286, 371, 419, 427, 275, 811

(56) References Cited

U.S. PATENT DOCUMENTS

| | | | | |
|---|---|---|---|---|
| 4,112,486 | A | | 9/1978 | Tovi |
| 4,353,110 | A | | 10/1982 | Ellis |
| 4,598,345 | A | * | 7/1986 | Kleeman ..... 362/233 |
| D287,413 | S | | 12/1986 | Kusmer et al. |
| 5,057,985 | A | | 10/1991 | Kreutzer, Jr. et al. |
| 5,176,442 | A | | 1/1993 | Richardson |
| 5,367,444 | A | | 11/1994 | Bornhorst et al. |
| D359,574 | S | | 6/1995 | Bornhorst et al. |
| 5,502,627 | A | | 3/1996 | Hunt et al. |
| 5,515,254 | A | | 5/1996 | Smith et al. |
| 5,580,164 | A | | 12/1996 | Maddox et al. |
| 5,584,560 | A | | 12/1996 | Gosswiller et al. |
| 5,673,989 | A | | 10/1997 | Gohl et al. |
| 5,788,365 | A | | 8/1998 | Hunt et al. |
| 5,882,107 | A | * | 3/1999 | Bornhorst et al. ..... 362/281 |
| D413,995 | S | | 9/1999 | Lee et al. |
| 6,280,056 | B1 | | 8/2001 | Dolan et al. |
| 6,416,195 | B1 | | 7/2002 | Lin |
| D464,756 | S | | 10/2002 | Layne et al. |
| 2002/0159262 | A1 | | 10/2002 | Romano et al. |

FOREIGN PATENT DOCUMENTS

| | | |
|---|---|---|
| FR | 2591716 | 6/1987 |
| GB | 2046892 | 11/1980 |

* cited by examiner

*Primary Examiner*—John Anthony Ward
(74) *Attorney, Agent, or Firm*—Roylance, Abrams, Berdo & Goodman, L.L.P.

(57) ABSTRACT

A luminaire includes a base, a frame supporting a lamp, an optical assembly and an arm connecting the base and the frame. The arm has opposite first and second terminal ends rotatably coupled to the base and the frame, respectively, first and second opposite sides extending between the first and second terminal ends, and first and second actuating members unitary with the arm. The first actuating member extends from the first side at the first terminal end and the second actuating member extends from the second side at second terminal end. The first actuating member rotates the arm with respect to the base about a first axis and the second actuating member rotates the frame with respect to the arm about a second axis, perpendicular to the first axis.

21 Claims, 8 Drawing Sheets

AUTOMATED LUMINAIRE WITH LIGHT BEAM POSITION ADJUSTMENT

RELATED APPLICATIONS

This application claims the benefit of U.S. Provisional Application Ser. No. 60/393,119 to Carroll W. Smith et al., entitled Automated Luminaire and filed on Jul. 3, 2002, the subject matter of which is hereby incorporated by reference.

FIELD OF THE INVENTION

The present invention relates to an articulating arm for an automated luminaire that supports an optical assembly and provides for rotation of the optical assembly about two angularly oriented axes, thereby allowing adjustable positioning of the light beam produced by the optical assembly anywhere within a hemispherical region.

BACKGROUND OF THE INVENTION

Conventional light fixtures typically utilize an articulation arm assembly which is pivotable about the X axis and the Y axis, or the pan and tilt axes. These articulation arms are most often constructed approximating a U-shape with one pivot point being centrally located in the base of the U, thereby providing the pan pivot, with two additional pivot points located at the top of the U thereby providing the tilt pivot. A driving mechanism, such as a motor, is located in proximity to each of the pivot points. Utilizing a belt or gear, each motor is connected to the arm so as to be able to rotate the arm about its pan and tilt axes. Typically this range of motion is limited to 400 degrees of pan movement and 270 degrees of tilt movement, such restrictions being imposed due to the need to provide wiring through the arm to the light source and control means within the light fixture.

Conventional articulating arms are typically constructed from several metal components, most often formed of sheet metal. This approach results in the use of numerous individual components affixed together by a large number of fasteners. The structure of the conventional arms is most often tubular in nature in order to obtain the necessary strength from flat or formed sheet metal components. Such a structure is overly complex, requires numerous parts and fasteners and is prone to bending particularly in applications such as concert lighting where the fixtures are frequently handled and transported.

Examples of conventional lighting fixtures with articulating arms include U.S. Pat. No. 6,280,056 to Dolan et al.; U.S. Pat. No. 5,788,365 to Hunt et al.; U.S. Pat. No. 5,584,560 to Gosswiller et al.; U.S. Pat. No. 5,580,164 to Maddox et al.; U.S. Pat. No. 5,502,672 to Hunt et al.; U.S. Pat. No. 5,515,254 to Maddox et al.; U.S. Pat. No. 5,367,444 to Bornhorst et al.; U.S. Pat. No. 5,176,442 to Richardson; U.S. Pat. No. 5,057,985 to Kreutzer, Jr. et al.; U.S. Pat. No. 4,112,486 to Tovi; U.S. Pat. No. Des. 413,995 to Lee et al.; U.S. Pat. No. Des. 359,572 to Bornhorst et al.; and U.S. Pat. No. Des. 287,413 to Kusmer et al., the subject matter of each of which are hereby incorporated by reference.

SUMMARY OF THE INVENTION

Accordingly, an object of the present invention is to provide an automated luminaire including an articulating arm supporting an optical assembly that allows pan and tilt positioning of the light beam anywhere within a hemispherical range.

Another object of the present invention is to provide an automated luminaire including an articulating arm that is formed as a one-piece unitary member.

Yet another object of the present invention is to provide an automated luminaire including an articulating arm with a passageway holding wiring for the luminaire, the passageway being adapted to prevent interference with the pan and tilt rotation of the arm and optical assembly.

The foregoing objects are basically attained by a luminaire including a base, a frame adapted to support an optical assembly, and an arm. The arm has opposite first and second terminal ends rotatably coupled to the base and the frame, respectively, first and second opposite sides extending between the first and second terminal ends, and first and second actuating members unitary with the arm. The first actuating member extends from the first side at the first terminal end and the second actuating member extends from the second side at second terminal end. The first actuating member is adapted to rotate the arm with respect to the base about a first axis and the second actuating member is adapted to rotate the frame with respect to the arm about a second axis.

The foregoing objects are also attained by a luminaire including a base, a frame adapted to support an optical assembly, and an arm. The arm includes opposite first and second terminal ends rotatably coupled to the base and the frame, respectively, by first and second rotation members, respectively. Each of the first and second rotation members are releasably attached to the first and second ends, respectively, and rotatably coupled with the base and frame, respectively. First and second actuating members are coaxial with each of the first and second rotation members. A continuous passageway is defined through the first rotation member, through the arm, and through the second rotation member. The passageway is adapted to hold wiring.

Other objects, advantages and salient features of the invention will become apparent from the following detailed description, which, taken in conjunction with annexed drawings, discloses a preferred embodiment of the present invention.

BRIEF DESCRIPTION OF THE DRAWINGS

Referring to the drawings which form a part of this disclosure.

DETAILED DESCRIPTION OF THE PREFERRED EMBODIMENT

Figure 1:
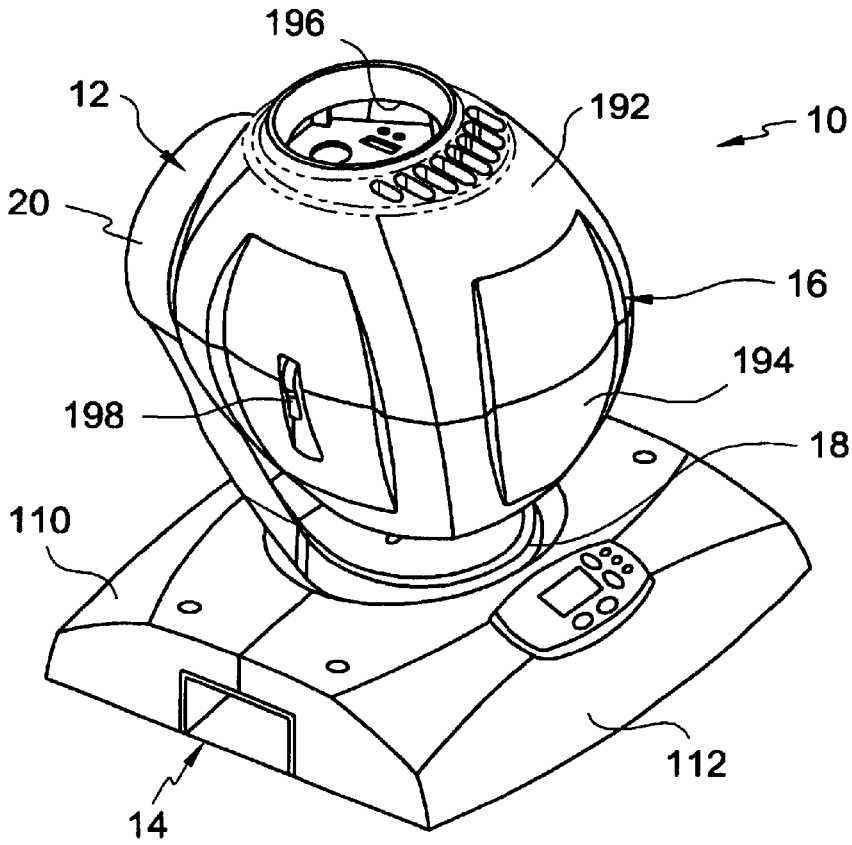
FIG. 1 is a perspective view of an automated luminaire in accordance with an embodiment of the present invention.

Referring to FIGS. 1–16, an automated luminaire 10 in accordance with one embodiment of the present invention generally includes an arm 12 rotatably connected to a base 14 at one end 18 and rotatably supporting an optical assembly 16 at the other end 20 in a cantilever manner. Arm 12 provides both pan and tilt rotation of the optical assembly 16, thereby allowing positioning of the light beam from optical assembly 16 anywhere at least within a hemispherical range. This single piece component arm 12 obviates that need to bond numerous pieces together, thereby providing assembly cost savings, weight savings, impact resistance, creep resistance, blemish resistance and damping. Also, wiring for operation of optical assembly 16 is extended from base 14 through arm 12 to optical assembly 16 without interference with the pan and tilt rotation of optical assembly 16.

Figure 7:
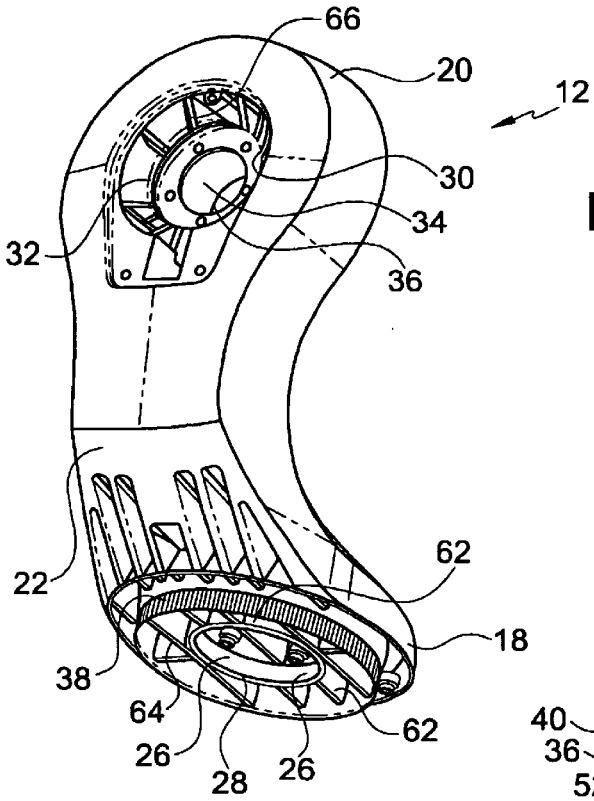
FIG. 7 is a rear perspective view of the arm of the automated luminaire illustrated in FIG. 1.
Figure 8:
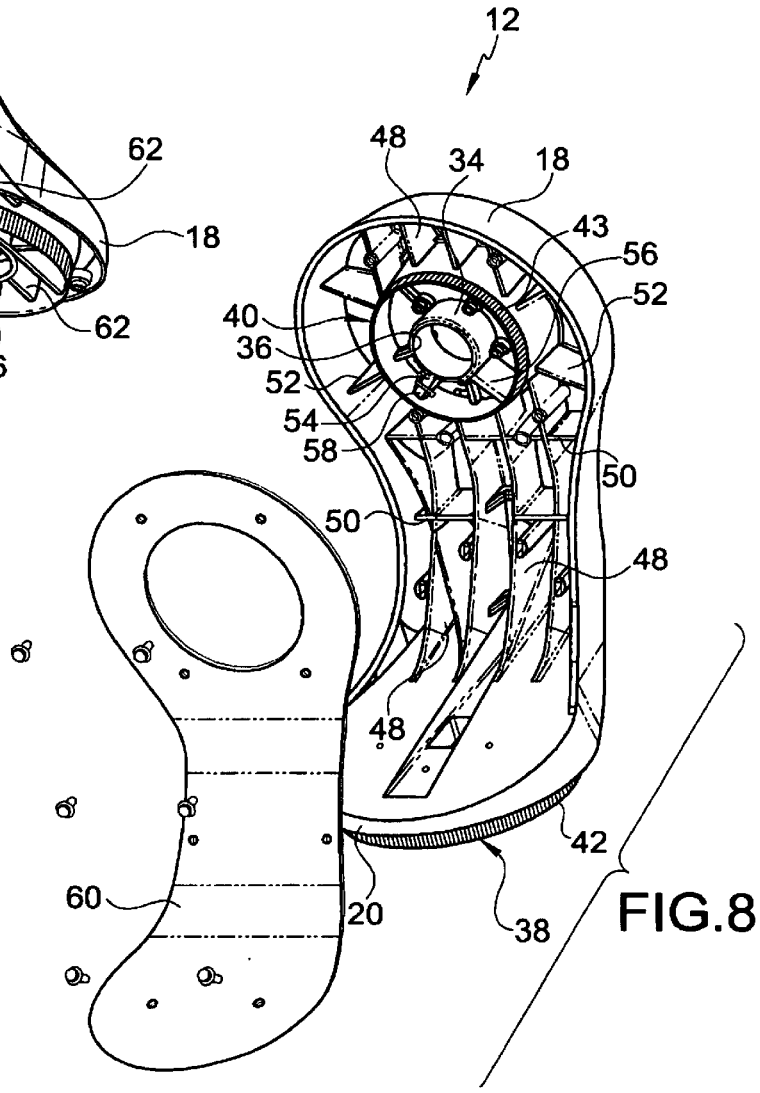
FIG. 8 is a front perspective view of the arm of the automated luminaire illustrated in FIG. 1, showing a cover exploded from the arm.
Figure 9:
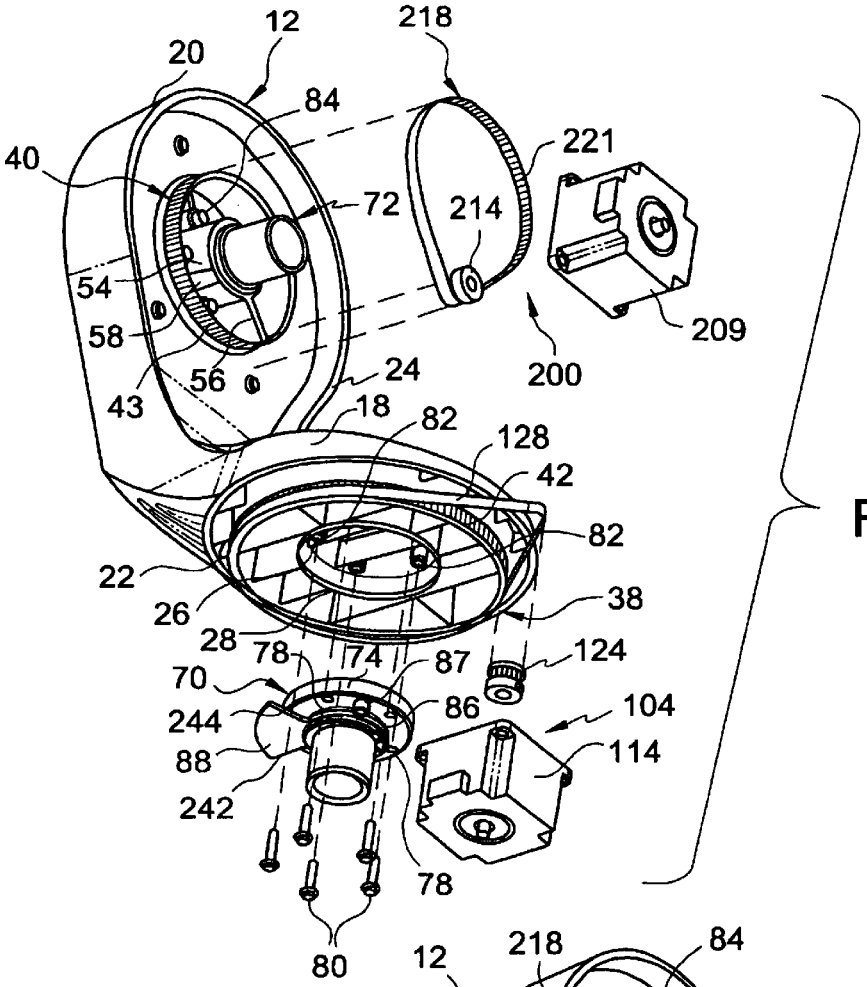
FIG. 9 is an exposed bottom perspective view of the arm of the automated luminaire illustrated in FIG. 9, showing the arm, rotational members and first and second actuators.

Arm 12 is preferably an injection molded unitary one-piece member, made of either thermoplastic or a thermoplastic composite. Arm 12 includes first and second ends 18 and 20 and first and second sides 22 and 24 extending between ends 18 and 20. First end 18 includes a recess 26 that is accessible from first side 22 of arm 12 at an opening 28, as seen in FIG. 9. Second end 20 includes a recess 30 that is also accessible from the first side 22 at a second opening 32, as seen in FIG. 7. Opposite second opening 32 of recess 30 is a tubular channel 34 that terminates at a third or channel opening 36 on second side 20, as seen in FIG. 8, and forms a continuous passageway with recess 30.

Extending around recess opening 28 at arm first end 18 is a first actuating member 38, as best seen in FIGS. 6–11. Similarly, a second actuating member 40 extends around opening 36 of tubular channel 34, as best seen in FIGS. 3 and 8–11. Each actuating member 38 and 40 is preferably a gear for facilitating rotational movement of arm 12 with respect to base 14 and rotational movement of optical assembly 16 with respect to arm 14. First gear 38 extends outwardly from first side 22 of arm 12 and defines a first rotational axis 44. Second gear 40 extends outwardly from second side 24 of arm 12 and defines a second rotational axis 46. First and second rotational axes 44 and 46 are preferably perpendicular (FIG. 4). Each actuating member or gear 38 and 40 includes a plurality of teeth 42 and 43 concentric with recess opening 30 and channel opening 36, respectively.

A plurality of ribs 48, 50, 54 and 56 (FIG. 8) are provided throughout arm 12 for increasing the strength of arm 12 and also aiding dampening noise and vibration. At arm second side 24, longitudinal reinforcing ribs 48 extend therefrom and between first and second ends 18 and 20 following the contour of arm 12, as best seen in FIG. 8. These ribs 48 transfer stresses from arm end 20 which supports optical assembly 16 to arm end 18 supported by base 14. Cross bracing ribs 50 are also disposed on arm second side 24 to provide additional torsional stiffening. Radial ribs 52 disposed radially around second gear 40 provide additional stiffening and spreading of load at arm end 20 where optical assembly 16 is rotatably supported. First and second spaced radial ribs 54 and 56 extend radially between channel opening 36 and second gear 40. First radial rib 54 preferably has a position detection switch 58, see FIG. 8, mounted thereon. First and second radial ribs 54 and 56 act as a mechanical stops for limiting rotation movement of optical assembly 16 and preventing damage to wiring of the luminaire 10. A cover 60 can be provided to cover second side 24 and hide ribs 48, 50 and 52. Similar longitudinal and cross bracing ribs 62 and 64 are also provided on arm first side 22 at arm first end 18 within an area bordered by first gear 38 and around recess 26, as best seen in FIG. 7. Radial ribs 66 are also preferably provided in recess 30 at arm second end 20 which extend radially from tubular channel 34.

Arm 12 is preferably made of a nylon plastic resin that incorporates fiberglass strands for additional reinforcement. This material has a very high structural strength and provides high impact resistance. Also, this material minimizes creep, which is the change in shape over time. However, any known material, such as any plastic or metal, can be used to form arm 12 as long as the material has sufficient strength to support optical assembly 16. Preferably arm 12 is single injection molded member including first and second gears 38 and 40 to form a unitary one-piece arm. However, arm 12 can be made from separate components that are integrally attached. For example, gears 38 and 40 can be made separately from arm 12 and attached thereto in any known manner.

Figure 11:
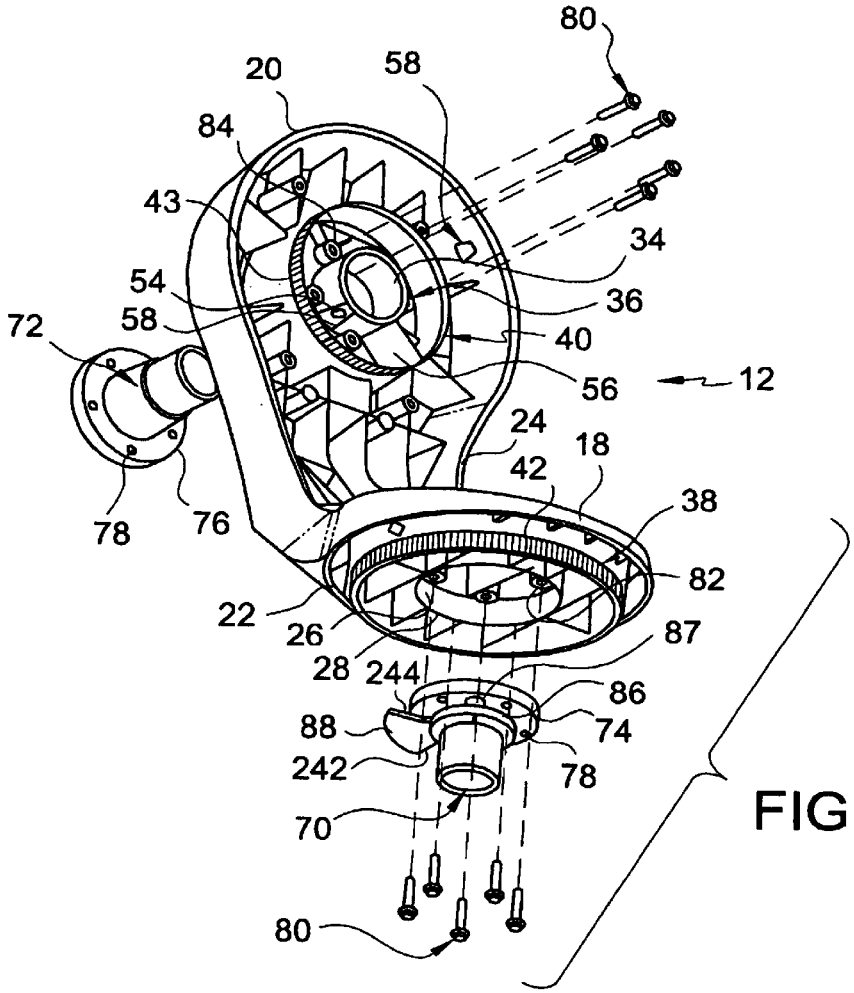
FIG. 11 is an exploded perspective view of the arm of the automated luminaire illustrated in FIG. 1, showing the rotational members exploded from the arm.

Recess 26 of arm 12 supports pan rotation member 70 for rotational engagement with base 14. Recess 30 and channel 34 support tilt rotation member 72 for rotational engagement with optical assembly 16. Preferably, pan and tilt rotation members 70 and 72 are tubes with shoulder ends 74 and 76 that have diameters substantially wider than the tubes. Tubes 70 and 72 are preferably metal, which provide mechanical support and a rotational mechanism for arm 12. Each shoulder end 74 and 76 includes concentric holes 78 for receiving fasteners 80. Holes 78 of pan tube 70 correspond to internally threaded bosses 82 disposed in recess 26 at arm first end 18, as seen in FIG. 9. Holes 78 of tilt tube 72 correspond to threaded bosses 84 disposed around tubular channel 34 near its opening 36 at arm second end 20, as seen in FIG. 11. Pan rotation member 70 additionally includes a pan stop ring 86 rotatably engaged with tube 70 and a stop 87, such as a screw, threaded into shoulder 74, as best seen in FIG. 9. Stop ring 86 includes a flange extension 88.

Pan tube 70 is coupled to arm first end 18 by inserting shoulder end 74 into recess 26 so that pan tube 70 extends outwardly from arm first side 22 and is coaxial with first gear 38. Shoulder holes 78 are aligned with recess bosses 82. Fasteners 80 are inserted through holes 78 and threaded into bosses 82, thereby releasably attaching pan tube 70 to arm 12. Tilt tube 72 is coupled to arm second end 20 by inserting tube 72 through recess 30, through tubular channel 34 and through channel opening 36 so that tube 72 extends outwardly from arm second side 24 and is coaxial with second gear 40. Holes 78 of tilt tube 72 are aligned with bosses 84 around channel 34. Fasteners 80 are inserted through holes 78 and threaded into bosses 82, thereby releasably attaching tilt tube 72 to arm 12.

As seen in FIGS. 1–5, base 14 of luminaire 10 is preferably formed of sheet metal and preferably includes a base plate 90 with first and second bent ends 92 and 94 providing strength to plate in a lateral direction. A central beam member 96 extends between ends 92 and 94 to provide strength in a longitudinal direction. Beam member 96 forms a C-shaped channel 98 that is open at both ends 100. Electronics 102 for luminaire 10, such as motor and logic power supplies, motor and logic drive components and a lamp power supply, are supported on plate 90. Supported by beam member 96 are a first actuator 104 and a first bearing assembly 106. First actuator 104 rotatably actuates first gear 38 of arm 12 and first bearing assembly 106 rotatably engages pan tube 70. A fan (not shown) can be optionally included in beam member 96 for introducing air flow through base 14 and provide cooling to electronics 102. Retaining clips 108 provided on bent ends 92 and 94 allow attachment of molded base first and second covers 110 and 112. Base 14 can alternatively be a wall support, such as a ceiling, that hides the electronics 102 and supports first actuator 104 and first bearing assembly 106 in the same manner for rotational engagement with arm 12.

Figure 10:
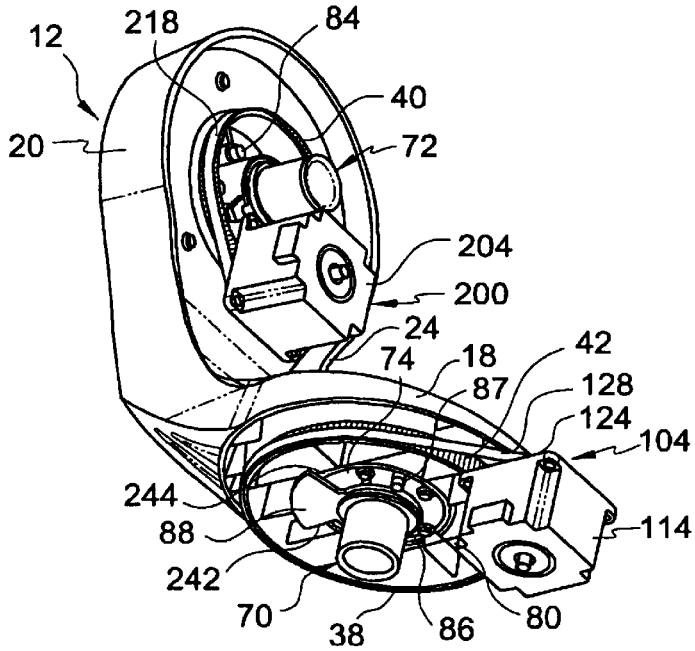
FIG. 10 is a bottom perspective view of the arm similar to FIG. 9, showing the rotational members and first and second actuators assembled with the arm.

First actuator 104 preferably includes a pan motor 114, as seen in FIGS. 4, 5, 9, 10, 12 and 13, received within beam member 96 and secured to a bracket 116 disposed on an outer surface 118 of a beam member wall 120 via fasteners 122. Motor 114 is also operatively engaged with a pulley 124 by a stem 126, which extends through beam member wall 120. Pulley 124 in turn engages a first belt 128 adapted to wrap around first gear 38, as best seen in FIGS. 9 and 10. First belt 128 preferably includes a plurality of teeth 130, which engage teeth 42 of first gear 38.

Figure 5:
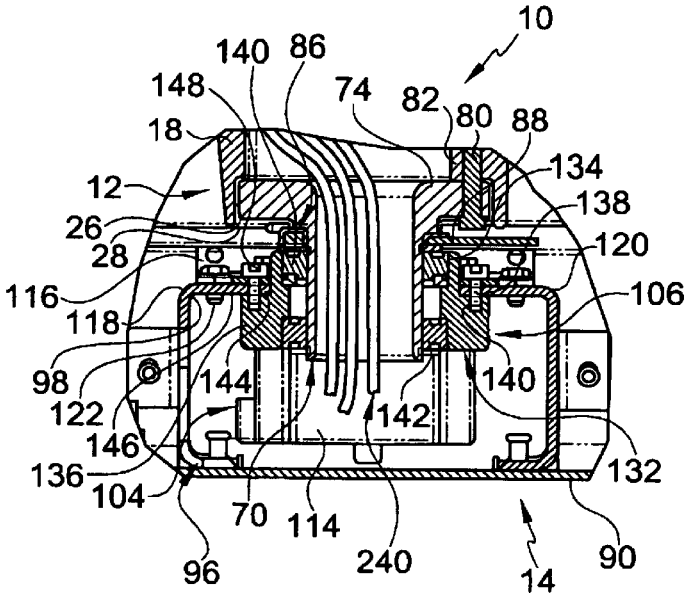
FIG. 5 is an enlarged partial side elevational view in section similar to FIG. 4, showing the rotational engagement of the base and arm.

First bearing assembly 106 preferably includes a main body 132 with first and second tubular sections 134 and 136 and a transition shoulder 138 therebetween. First tubular section 134 has a substantially smaller outside diameter than second tubular section 136, as seen in FIG. 5. Transition shoulder 138 includes a plurality of concentric threaded bores 140 for receiving fasteners 142. First and second tubular sections 134 and 136 support first and second ring-shaped bearings 140 and 142 within main body 132. First bearing assembly 106 is releasably attached to base 14 at beam member 96 by placing first section 134 through a central opening 144 in beam member wall 120 that is sized to accommodate first section 134. Transition shoulder 138 abuts an inner surface 146 of beam member wall 120, as seen in FIG. 5, and threaded bores 140 thereof are aligned with corresponding holes in beam member wall 120. Fasteners 148 can then been inserted through the holes in beam member wall 120 and into threaded bores 140 of shoulder 138.

Figure 3:
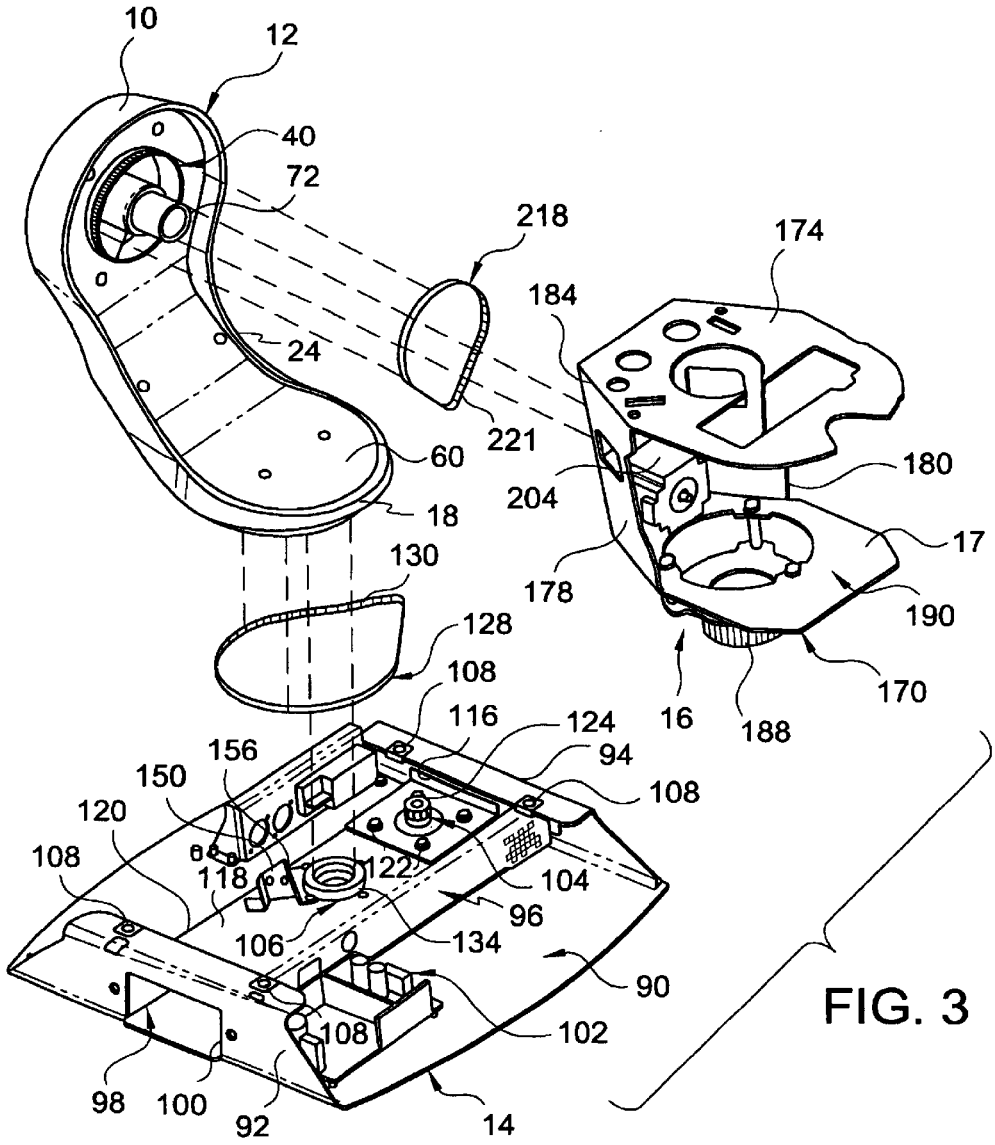
FIG. 3 is an exploded perspective view of the automated luminaire illustrated in FIG. 1, without covers of the luminaire and showing a base, an arm and a frame of the luminaire.
Figure 4:
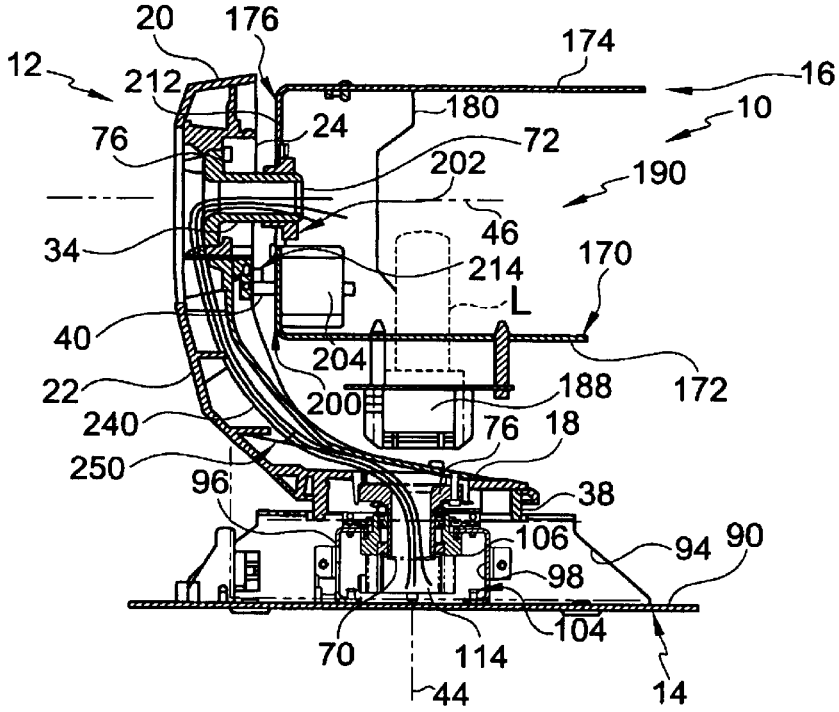
FIG. 4 is a side elevational view in section of the automated luminaire illustrated in FIG. 1, showing the base, arm and frame assembled.
Figure 6:
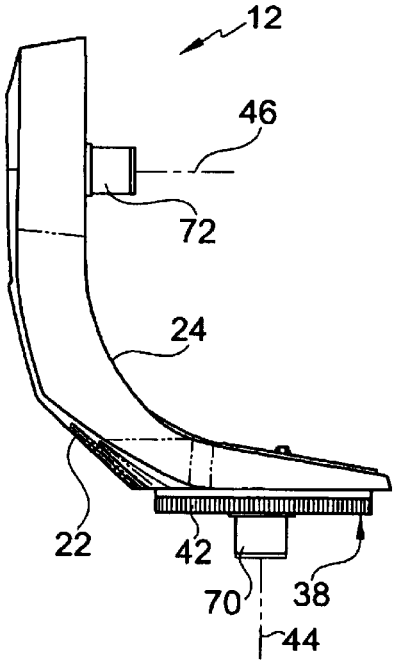
FIG. 6 is a side elevational view of the arm of the automated luminaire illustrated in FIG. 1, showing rotational members assembled with the arm.
Figure 14:
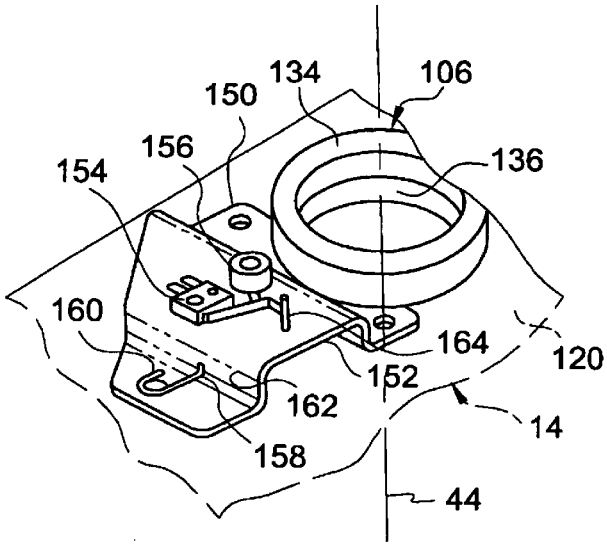
FIG. 14 is a perspective view of a stop bracket and bearing assembly of the automated luminaire illustrated in FIG. 1.
Figure 15:
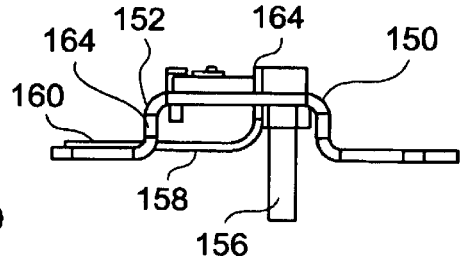
FIG. 15 is a side elevational view of the stop bracket illustrated in FIG. 14.

As seen in FIGS. 3, 14 and 15, attached to the outer surface 118 of beam member wall 140 adjacent first section 134 of bearing assembly 106 is a stop bracket 150 for limiting pan rotation of arm 12 about first axis 44 to 540 degrees and preventing damage to wiring. Stop bracket 150 includes a raise middle portion 152 supporting a detection switch 154 and a stop 156, such as a screw. A spring 158 extends under middle portion 152 with one end 160 extending out of one side 162 of middle portion and the other end 164 extending through middle portion 152, as best seen in FIG. 15. Stop 156 engages stop ring 86 of pan tube 70.

Figure 2:
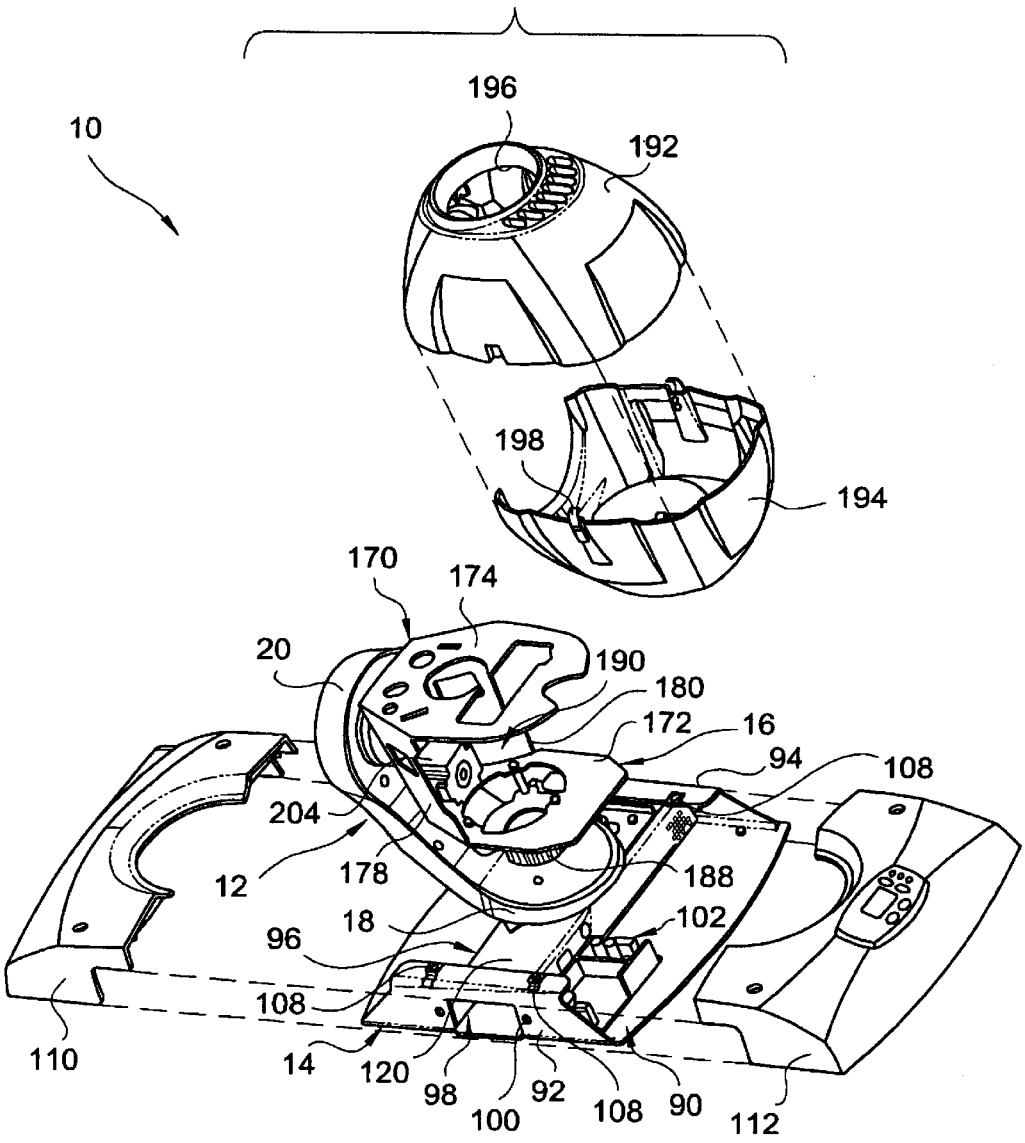
FIG. 2 is an exploded perspective view of the automated luminaire illustrated in FIG. 1.
Figure 16:
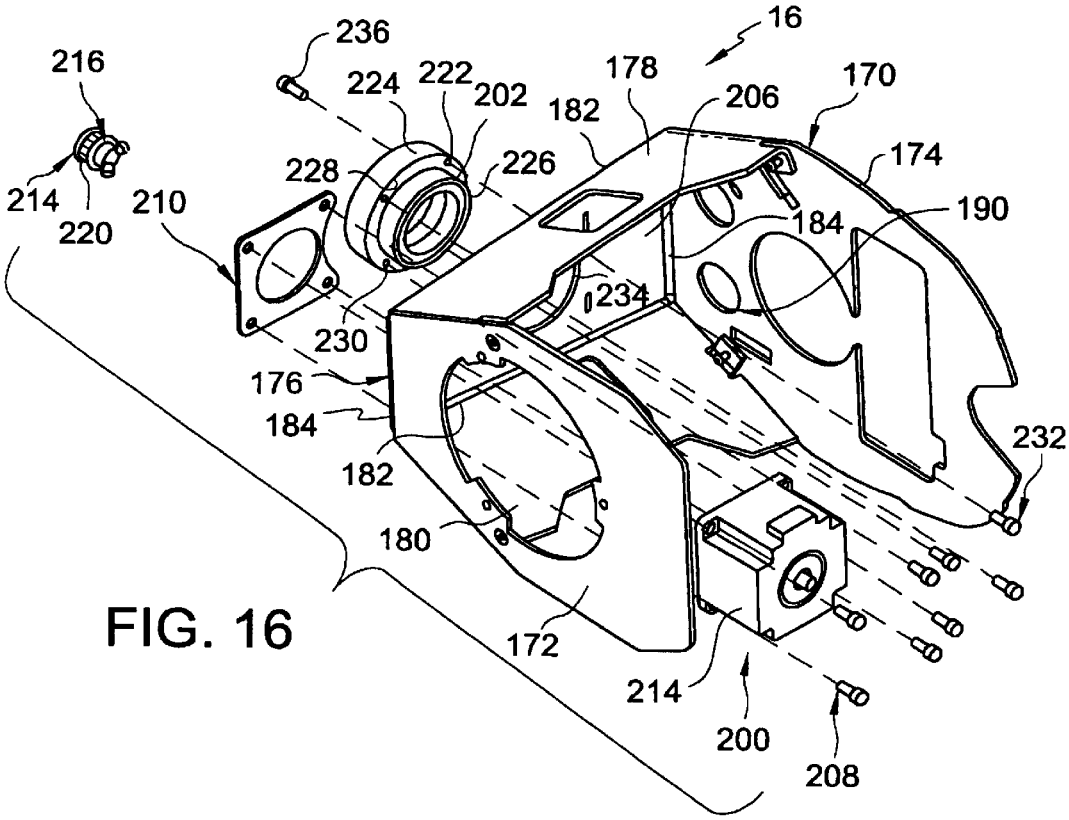
FIG. 16 is an exploded perspective view of a frame of the automated luminaire illustrated in FIG. 1; showing a bearing assembly and an actuator exploded from the frame.

As seen in FIGS. 1–4, 9, 10 and 16, optical assembly 16 includes a frame 170 that is preferably formed of sheet metal. Frame 170 includes first and second end walls 172 and 174, a main wall 176 extending between first and second end walls 172 and 174 and two secondary walls 178 and 180 extending from side edges 182 of main wall 176 and side edges 184 of end walls 172 and 174, as best seen in FIG. 16. First end wall 172 adjustably supports a lamp cap 188, as seen FIG. 4, designed to accommodate different lamp types L, such as 150 watt, 250 watt or 400 watt lamps. An optical area 190 is defined between end walls 172 and 174, main wall 176 and secondary walls 182 and 184 for holding the optics of luminaire 10, such as a lamp and reflector and associated components, such as a hot mirror or fan, as disclosed in commonly owned, co-pending U.S. patent application Ser. No. 10/434,484 to Carroll W. Smith et al., entitled Reflector Assembly for Automated Luminaires filed on May 9, 2003, the subject matter of which is hereby incorporated by reference. First and second covers 192 and 194 enclose frame 170 and the optics with first cover 192 having an opening 196 allowing the light beam of luminaire 10 to shine therethrough. Preferably, covers 192 and 194 are snapped or latched together around frame 170 by a conventional latching mechanism 198, as best seen in FIG. 2.

Frame 170 supports a second actuator 200 for rotatably actuating second gear 40 of arm 12 and a second bearing assembly 202 that rotatably engages tilt tube 72. Second actuator 200 is substantially identical to first actuator 104. Second actuator 200 includes a tilt motor 204 releasably attached to an inner surface 206 of frame main wall 176 via fasteners 208, such as screws, which extend through motor 204 and a bracket 210 disposed on the outer surface 212 of main wall 176. Motor 204 is operatively engaged with a pulley 214 by a stem 216 similar to stem 126, which extends through main wall 176. Pulley 214 in turn engages second gear 40 and a second belt 218 similar to first belt 128 and adapted to wrap around pulley 214 and second gear 40, as best seen in FIGS. 9 and 10. Pulley 214 preferably includes a plurality of teeth 220 for engaging the teeth 43 of second gear 40. Similarly, second belt 218 preferably includes a plurality of teeth 221.

Second bearing assembly 202 is substantially identical to first bearing assembly 106 including main body 222 with first and second tubular sections 224 and 226 and a transition shoulder 228 therebetween. Transition shoulder 228 includes a plurality of concentric threaded bores 230 for receiving fasteners 232, such as screws, as seen in FIG. 16. Second bearing assembly 202 is releasably attached to frame main wall 176 by extending first tubular section 224 through an opening 234 in main wall 176 until transition shoulder 228 abuts the outer surface 212 of main wall 176. Fasteners 232 can then be extended through holes in main wall 176 corresponding to and aligned with bores 230 of shoulder 228, thereby securing second bearing assembly 202 to frame 170. A stop 236, such as a screw, is threaded into shoulder 228 for limiting rotation of frame 170 with respect to arm 12 and about second axis 46 to about 270 degrees by engaging the upper portions of ribs 54 and 56 of arm 12.

Referring to FIGS. 1–16, to assemble luminaire 10, arm 12 is rotatably mounted to base 14 and frame 170 of optical assembly 16 is rotatably mounted to arm 12. Alternatively, arm 12 can be mounted to a wall structure (not shown), such as a ceiling, in the same manner arm 12 is mounted to base 14. To mount arm 12 to base 14, pan tube 70 extending from arm first end 18 is slidably inserted into first and second tubular sections 134 and 136 of bearing assembly 106 of base 14, as seen in FIG. 5. This allows pan tube 70 and arm 12 to freely rotate with respect to base 14 and about first axis 44. Pan stop ring 86 is between shoulder 74 of tube 70 and first tubular section 134 of bearing assembly 106.

Figure 12:
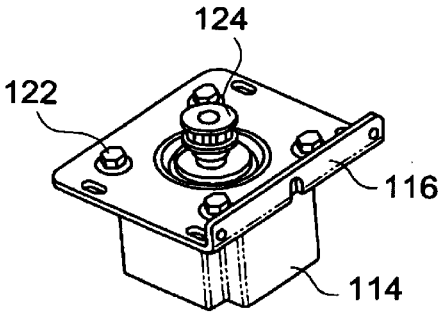
FIG. 12 is a top perspective view of an actuator of the automated luminaire illustrated in FIG. 1.
Figure 13:
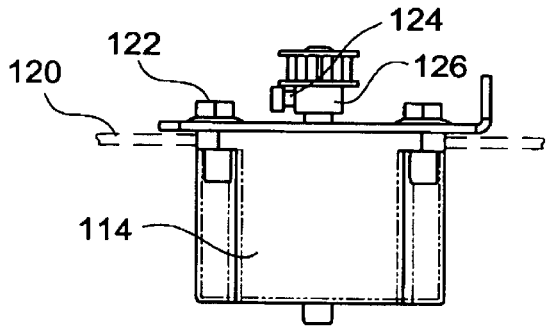
FIG. 13 is a side elevational view of the actuator illustrated in FIG. 12.

Once pan tube 70 is received by bearing assembly 106, pan actuator 104, including pan motor 114, pulley 124 and first belt 128, is coupled to first gear 38 to rotate arm 12 with respect to base 14. Specifically, pan motor 114 is attached to base 14 on beam wall 120 via bracket 116 and fasteners or screws 122, as seen in FIGS. 3, 5 and 13. Pulley 125 is coupled to motor 114 via stem 126, as seen in FIGS. 12 and 13, so that pulley 124 extends outside of base beam member 96, as seen in FIG. 3. First belt 128 is wrapped around first gear 38, so that the teeth 42 of gear 38 engage teeth 130 of belt 128. Belt 128 is also coupled to pulley 124, as seen in FIGS. 9 and 10. Electronics 102 of luminaire 10, disposed on base 14, operate motor 114 to rotate arm 12 with respect to base 14. Specifically, motor 114 rotates pulley 124 which in turn rotates belt 128. Since belt 128 is engaged with gear 38, particularly due to belt teeth 130 engaging gear teeth 42, rotation of belt 128 rotates gear 38 and arm 12 about first axis 44 in either a clockwise or counterclockwise direction.

As seen in FIG. 5, pan stop ring 86 prevents arm 12 from rotating about axis 44 for more than about 540 degrees, thereby preventing damage to luminaire 10 and wiring 240. Stop ring 86 is disposed laterally between rotating stop 87 of pan tube 70 and stationary stop 156 of base stop bracket 150 with either of first and second edges 242 and 244 of ring flange 88 engaging stops 87 and 156. Stop 156, as seen in FIGS. 3 and 14, on base 14 is disposed radially further away from axis 44 than stop 87 on pan tube 70, and flange 88 of stop ring 86 has a length sufficient to engage stop 156. This allows pan tube 70 and arm 12 to rotate in either a clockwise or counterclockwise direction until stop ring flange 88 is sandwiched between stationary stop 156 and rotating stop 87, thereby providing up to 540 degrees of rotation. For example, as arm 12 and pan tube 70 rotate with respect to base 14 in a first direction, such as clockwise with respect to axis 44 and arm first side 22, stop 87 of tube 70 catches one side edge 242 of flange 88 of pan stop ring 86, see FIGS. 9 and 10, so that both tube 70 and ring 86 rotate simultaneously in that first direction. Stop 87 and ring 86 continue to rotate together until stationary stop 156 of base 14 catches the opposite side edge 244 of ring flange 88, with flange 88 being trapped between stop 156 and stop 87. Arm 12 and pan tube 70 can then be rotated in an opposite second direction, such as counterclockwise with the respect to axis 44 and arm first side 22, away from flange side edge 242 until rotating stop 87 of tube 70 catches opposite side edge 244. Ring 86 and tube 70 will then rotate together in the second or counterclockwise direction until stationary stop 156 of base 14 catches side edge 242 of ring flange 88 so that flange 88 is trapped between stops 87 and 156. Detection switch 154 disposed on stop bracket 150 communicates to electronics 102 of luminaire 10 the rotational position of arm 12. Although it is preferable to employ this stopping mechanism including stop ring 86, and stops 87 and 156 to limit rotational movement, such as stopping mechanism can be elimination to allow unrestricted rotational movement.

To mount frame 170 to arm second end 20, bearing assembly 202 disposed in frame main wall 176, slides over tilt tube 72 extending from arm second side 24 so that tube 72 is received in first and second bearing sections 224 and 226. This allows frame 170 to rotate with respect to arm 12 about second axis 46. Tilt actuator 200 is then coupled to second gear 40 of arm 12. In particular, tilt motor 204 is attached to the inner surface 206 of main wall 176 of frame 170 via bracket 210 and fasteners 232, as seen in FIG. 16. Pulley 214 is coupled to motor 204 by stem 216 outside of main wall 176, as seen in FIG. 3. Second belt 218 wraps around second gear 40 and pulley 214 so that pulley 214 is sandwiched between gear 40 and belt 218, as seen in FIGS. 9 and 10. Electronics 102 operates motor 204 to rotate pulley 214 around gear 40, thereby rotating optical assembly 16 and frame 170 with respect to arm 12. Specifically, pulley 214 tracks around gear 40 with the teeth 220 of pulley 214 engaging the teeth 43 of gear 40. Belt 218 holds pulley 214 on gear 40 and teeth 221 of belt 218 engage and disengage the teeth 43 of gear 40 as pulley 214 tracks around gear 40.

Stop 236 extending from second bearing assembly 202 prevents rotation of frame 170 with respect to arm 12 greater than about 270 degrees. In particular, as frame 170 rotates in either direction about axis 46, stop 236 catches the upper portions of first and second radial ribs 54 and 56 disposed around opening 36 of arm 12, as best seen in FIG. 9. Since radial ribs 54 and 56 are taller than the other radial ribs 52 disposed around opening 34, stop 236 will only engage ribs 54 and 56. Detection switch 58 disposed on either rib 54 and 56 communicates to the electronics 102 the rotational position of frame 170. Although it is preferable to use this stopping mechanism of stop 236 and ribs 54 and 56, such a stopping mechanism can be eliminated. Also, ribs 54 and 56 can be spaced to provide either less than or greater than 270 degrees of rotation.

As seen in FIG. 2, covers 110 and 112 are attached to base 14 and covers 192 and 194 are attached to frame 170. Specifically, retaining clips 108 disposed on base bent ends 92 and 94 hold covers 110 and 112 on base 14. Covers 192 and 194 are disposed on first and second end walls 172 and 174, respectively, and latched together with latch 198.

As seen in FIGS. 4 and 5, a continuous passageway 250 is defined between frame 170 of optical assembly 16 and base 14 through arm 12 allowing wiring 240 to extend from base 14 to optical assembly 16. Specifically, passageway 250 is defined through pan tube 70, through arm 12 and through tilt tube 72. This allows wiring 240 to extend from base 14 through passageway 250 to optical assembly 16 while also allowing arm 12 to rotate with respect to base 14 and frame 170 of optical assembly 16 to rotate with respect to arm 12 without damaging wiring 240.

While a particular embodiment has been chosen to illustrate the invention, it will be understood by those skilled in the art that various changes and modifications can be made therein without departing from the scope of the invention as defined in the appended claims.

What is claimed is:

1. A luminaire, comprising:

a base;

a frame supporting a lamp and an optical assembly; and a unitary one-piece arm having opposite first and second terminal ends rotatably coupled to said base and said frame, respectively, first and second opposite sides extending between said first and second terminal ends, and first and second actuating members unitary with said arm, said first actuating member extending from said first side at said first terminal end and said second actuating member extending from said second side at second terminal end;

whereby said first actuating member can rotate said arm with respect to said base about a first axis and said second actuating member can rotate said frame with respect to said arm about a second axis.

2. A luminaire in accordance to claim 1, wherein each of said first and second actuating members is defined by a gear unitary with said arm and concentrically disposed with respect to one of said first and second axes, respectively.

3. A luminaire in accordance to claim 1, wherein said first axis is substantially perpendicular to said second axis.

4. A luminaire in accordance to claim 1, wherein a first actuator is disposed in said base and coupled to said first actuating member for rotating said arm about said first axis; and a second actuator is disposed in said frame and coupled to said second actuating member for rotating said frame about said second axis.

5. A luminaire according to claim 4, wherein said first actuating member is a gear molded into said arm;

said first actuator includes a motor disposed in said base and a drive belt coupled to said motor that engages said gear, and said motor drives said belt to rotate said gear and said arm about said first axis.

6. A luminaire according to claim 4, wherein said second actuating member is molded into said arm;

said second actuator includes a motor disposed on said frame and a pulley coupled to said motor that engages said gear to rotate said frame about said second axis.

7. A luminaire according to claim 6, wherein each of said gear, pulley and motor being coupled to a belt.

8. A luminaire according to claim 1, wherein said arm rotates up to about 540 degrees of rotation with respect to said base; and said frame rotates up to about 270 degrees of rotation with respect to said arm.

9. A luminaire according to claim 1, wherein said arm includes a plurality of stiffening ribs for strengthening said arm.

10. A luminaire according to claim 1, wherein said arm is formed of a thermoplastic material.

11. A luminaire, comprising:

a base;

a frame supporting a lamp and an optical assembly; and an arm including opposite first and second terminal ends rotatably coupled to said base and said frame, respectively, by first and second rotation members, respectively, each of said first and second rotation members releasably attached to said first and second ends, respectively, and rotatably coupled with said base and frame, respectively, first and second actuating members mounted on said arm and coaxial with each of said first and second rotation members, and a continuous passageway being defined through said first rotation member, through said arm, and through said second rotation member, said passageway holding wiring.

12. A luminaire according to claim 11, wherein each of said first and second rotation members are tubes.

13. A luminaire according to claim 11, wherein each of said first and second actuating members includes a gear concentrically disposed around said first and second rotation members, respectively.

14. A luminaire according to claim 11, wherein each of said first and second actuating members, respectively, is unitary with said arm.

15. A luminaire according to claim 11, wherein a first actuator is disposed in said base and coupled to said first actuating member for rotating said arm about a first axis; and a second actuator is disposed in said frame and coupled to said second actuating member for rotating said frame about a second axis, said first and second axes being substantially perpendicular.

16. A luminaire according to claim 15, wherein each of said first and second actuators is a motor.

17. A luminaire, comprising:

a base including a first actuator;

a frame supporting a lamp, an optical assembly and a second actuator; and a unitary one-piece arm including, opposite first and second terminal ends rotatably coupled to said base and said frame, respectively, first and second opposite sides extending between said first and second terminal ends, first and second actuating members unitary with said arm, said first actuating member extending from said first side at said first terminal end and said second actuating member extending from said second side at second terminal end, and said first actuating member rotating said arm with respect to said base about a first axis and said second actuating member rotating said frame with respect to said arm about a second axis, first and second rotation members releasably attached to said arm, each of said first and second rotation members being rotatably coupled with said base and frame, respectively, and coaxial with said first and second actuation members, respectively, and a continuous passageway extending through said first rotation member, through said arm, and through said second rotation member, said passageway receiving wiring.

18. A luminaire according to claim 17, wherein each of said first and second actuating members includes a gear concentrically disposed around said first and second rotation members, respectively.

19. A luminaire according to claim 17, wherein each of said first and second rotation members are tubes.

20. A luminaire according to claim 17, wherein a first actuator is disposed in said base and coupled to said first actuating member for rotating said arm about a first axis; and a second actuator is disposed in said frame and coupled to said second actuating member for rotating said frame about a second axis, said first and second axes being substantially perpendicular.

21. A luminaire according to claim 20, wherein each of said first and second actuators is a motor.

* * * * *